United States Patent [19]

Cranford, Jr. et al.

[11] 4,453,768

[45] Jun. 12, 1984

[54] PORTABLE RECLINING EXAMINATION CHAIR

[75] Inventors: H. Bruce Cranford, Jr., Damascus; L. Thomas Geasey, Thurmont; Mark F. Arnold, Westminster, all of Md.

[73] Assignee: The United States of America as represented by the Secretary of the Army, Washington, D.C.

[21] Appl. No.: 323,626

[22] Filed: Nov. 20, 1981

[51] Int. Cl.[3] ..... A47C 4/02

[52] U.S. Cl. ..... 297/440; 297/17; 297/129

[58] Field of Search ..... 297/440, 17, 129, 423, 297/429; 312/235 R; 108/33, 42

[56] References Cited

U.S. PATENT DOCUMENTS

| | | | |
|---|---|---|---|
| 2,609,864 | 9/1952 | Gates, Jr. | 297/429 |
| 3,765,718 | 10/1973 | Chen | 297/17 |
| 3,909,061 | 9/1975 | Johnson | 297/17 |
| 4,025,107 | 5/1977 | Chippa | 297/17 |
| 4,193,630 | 3/1980 | Steele | 297/17 |

FOREIGN PATENT DOCUMENTS

| | | | |
|---|---|---|---|
| 281359 | 2/1914 | Fed. Rep. of Germany | 297/17 |
| 321477 | 6/1920 | Fed. Rep. of Germany | 297/17 |
| 2747321 | 4/1979 | Fed. Rep. of Germany | 297/440 |
| 198665 | 9/1938 | Switzerland | 108/33 |

*Primary Examiner*—William E. Lyddane
*Assistant Examiner*—Peter R. Brown
*Attorney, Agent, or Firm*—Neil K. Nydegger; Arthur I. Spechler; Werten F. W. Bellamy

[57] ABSTRACT

A portable multi-component reclining examination chair comprises a container wherein the chair's components can be stored for transportation. When removed from the container, the components attach to the container for assembly of the chair. Assembled, the chair uses the container as a stabilizing base to which are attached leveling legs, an adjustable seat having a reclinable back rest, a head rest, removable arm rests and either a leg rest or a foot rest depending on the particular use of the chair.

7 Claims, 3 Drawing Figures

PORTABLE RECLINING EXAMINATION CHAIR

The invention described herein may be manufactured, used and licensed by or for the government for governmental purposes without the payment to us of any royalty thereon.

BACKGROUND OF THE INVENTION

1. Field of the Invention

This invention relates to a portable examination chair and, more particularly, to a light weight reclining medical examination chair that can be disassembled for transportation within a small container, and the like.

2. Description of the Prior Art

There is a continuing need for the light weight, sturdy portable medical equipment for a number of reasons. The need for portable medical equipment in the practice of military medicine is quite clear. Other fields of medical practice also have a need for strong, light weight and readily transportable equipment, too. Illustratively, mobile medical practitioners who must travel to remote rural locations in which transportation facilities are primitive have a definite need for genuinely portable examining tables, chairs, and the like.

Naturally, these examining tables and chairs should satisfy certain criteria. Thus, for example, an examining table or chair should be dismountable without the use of any tools into a compact and light weight package for movement by air, land vehicle or human portage across difficult terrain. When assembled, however, the chair or table must not only be stable, but also steady and sufficiently strong to withstand the loads imposed by patient and various examination and operative procedures. More specifically, in addition to being of low cost and light weight, a portable examining table or chair should enjoy a wide range of medical applications. Ideally, a device of this character should be usable for dental, opthalmic, obstetrical, gynecological, ear, nose and throat examinations as well as for performing minor surgery, drawing blood samples and similar medical procedures in sitting and reclining positions.

These diverse requirements, however, are difficult to reconcile. Stability in medical examination equipment, for example, frequently is obtained through the use of an heavy and massive framework, as a glance at the cast iron base of almost any dentist's chair will disclose. This approach is entirely contrary to the need for mobility and light weight. In similar manner, applicability of an examining table of this nature to a number of medical specialties and procedures would seem to imply almost necessarily somewhat ornate and massive apparatus to adapt the device to several different needs. Once more, a portable medical examining table or chair requirement would appear to conflict with other, equally important features of a fully acceptable device.

There have been a number of proposals to solve the general problem of portable furniture. Some typical patents disclosing portable furniture are:

U.S. Pat. No. 3,765,718 granted Oct. 16, 1973 to C. S. Chen for "Holding Chair", U.S. Pat. No. 3,909,061 granted Sept. 30, 1975 to M. J. Johnson for "Portable Collapsible High Chair", U.S. Pat. No. 4,025,107 granted May 24, 1977 to C. Chippa for "Collapsible Spoon-Bottom Chair"; and U.S. Pat. No. 4,193,630 granted Mar. 18, 1980 to B. H. Steele for "Self Containing Collapsible High Chair".

None of these patents, however, suggest the foot and leg rests that are needed for medical examining tables and chairs, nor do these patents suggest conversion from a chair into a table in order to satisfy the needs of several different medical specialties. Consequently, there remains a requirement to provided a portable medical examining table or chair that reconciles the apparently conflicting criteria of portability and light weight vis-a-vis stability and flexibility in application.

SUMMARY OF THE INVENTION

These conflicting needs are resolved, to a great extent, through the practice of the invention. A medical examining device formed from light weight materials, for example, that embodies principles of the invention when dismantled is packed within a small container such as a trunk, a chest or a box. When erect, however, the container forms a major portion of the base of the device. In this way the container structure provides the stability, strength and height needed to render a light weight, dismountable device acceptable for medical purposes.

By providing a dismountable leg rest and hinging the back of the chair to the seat, it becomes possible to convert the chair swiftly into an examining table without resorting to special tools or elaborate extra fittings. Thus, the invention provides a light weight, compact and portable apparatus that is satisfactory for use in ophthalmic and dental examinations as well as examinations and minor surgical procedures in a number of other medical specialties.

The novel features of this invention, as well as the invention itself, both as to its organization and operation will best be understood from the accompanying drawings, taken in conjunction with the accompanying description, in which similar reference characters refer to similar parts, and in which:

DESCRIPTION OF THE PREFERRED EMBODIMENTS

Figure 2:
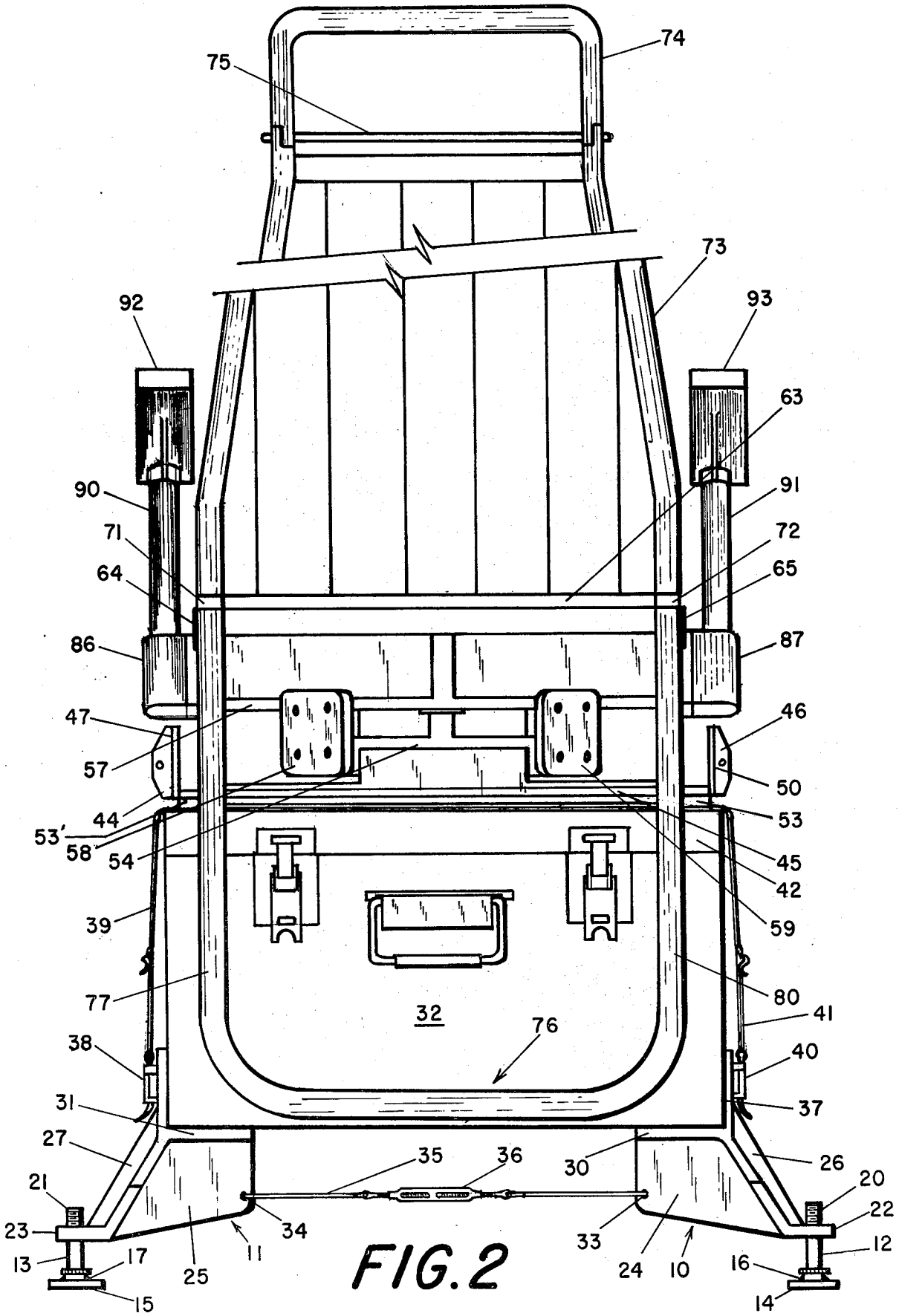
FIG. 2 is a front elevation of the embodiment of the invention shown in FIG. 1, with foot rest, also with some elements removed to clarify the drawing.

For a more complete application of the invention attention is invited to FIG. 2 which shows an illustrative embodiment of the invention assembled to provide a chair that is suitable for ophthalmic, dental or other appropriate medical purposes.

Four machined legs of which only the Zee shaped, horizontally spaced legs 10, 11 (as best shown in FIG. 2) are provided with individual leveling pads 12, 13. As shown, the pads 12, 13 each have flat bearing surfaces 14, 15 that are received for a limited degree of rotational movement in sockets 16, 17 which sockets are attached to respective ends of studs 20, 21. Threaded ends of studs 20, 21 are received in tapped bores formed in horizontally disposed feet 22, 23 that are formed integrally with the individual legs 10, 11.

Each of the legs 10, 11, moreover, has a vertically oriented web 24, 25 that is generally prependicular to respective Zee shaped flanges 26, 27. The flanges 26, 27 terminate, in their lower ends, with individual feet 22, 23. The upper ends of the flanges 26, 27, however, terminate at right-angled channel members 30, 31 each of which forms a respective ell for receiving an adjacent corner of a container 32.

As shown in the FIG. 2., the webs 24, 25 have respective bores 33, 34 that receive opposite ends of a brace 35. A turnbuckle 36 is connected to the brace 35 to adjust the tension that is applied to the brace as described subsequently.

Vertical member 37 of the channel 30 has, on the side opposite to the container 32, a manual, toggle latch 40 that enables an adjustable fastener 41 to press against container lid 42. Another toggle latch 38 and an adjustable fastener 39 also is provided for the leg 11. The combination of the toggle latch 40, the brace 35 and the toggle latch 38 on the leg 11 press the legs 10, 11 snugly against the respective edges of the container 32 and provide the stable and strong foundation that characterizes a salient feature of the invention.

Figure 1:
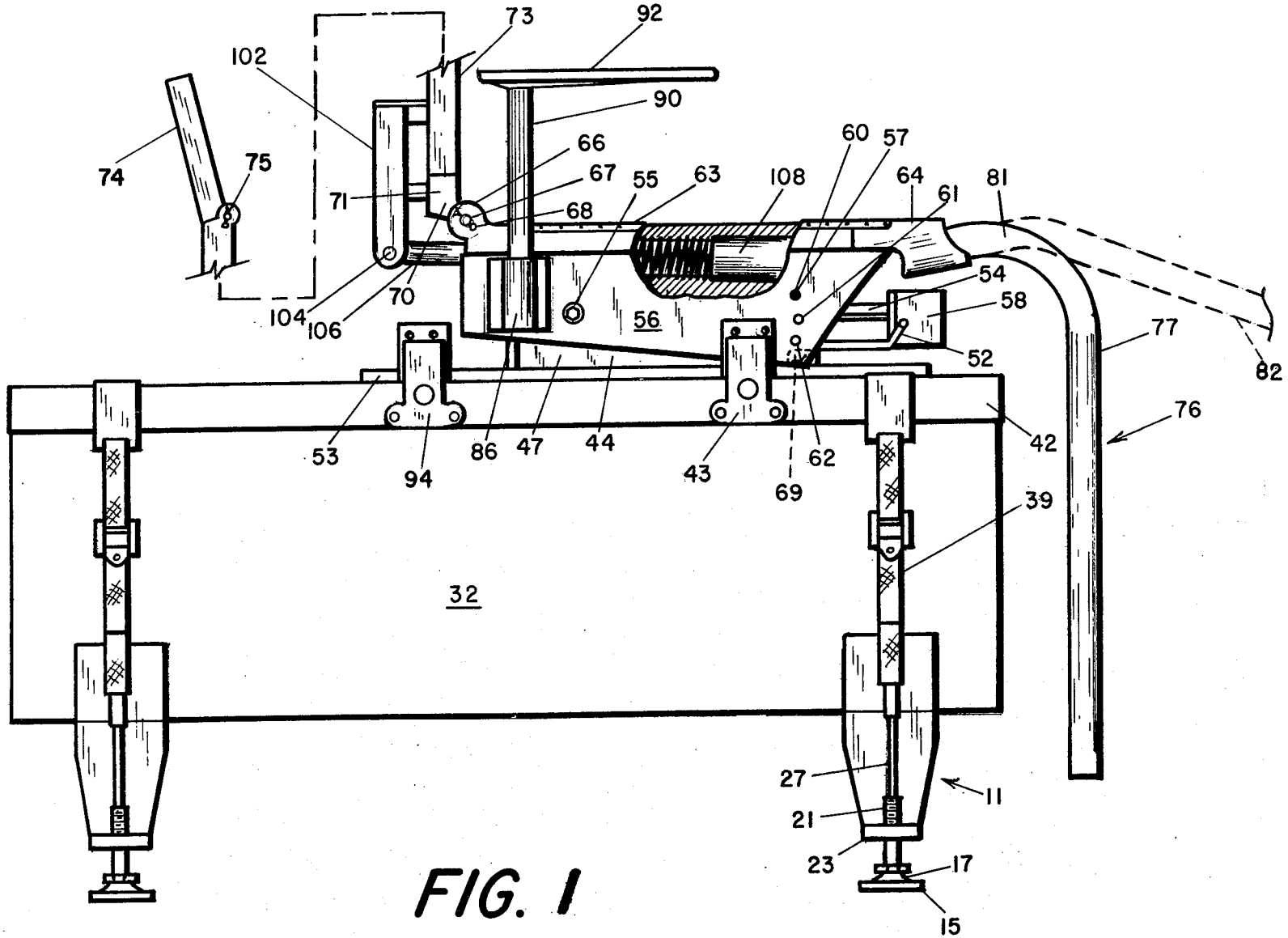
FIG. 1 is a side elevation of a fully assembled apparatus with some elements removed to clarify the drawing and expose some internal elements, also, the alternate embodiments using a foot rest or a leg rest (hatched lines) are shown.

An adjustable latch 43 and an adjustable latch 94, shown in FIG. 1, of the drawings, press the container lid 42 to a frame 44. As illustrated, in FIGS. 1 and 2, the frame 44 is formed in the shape of a shallow trough in which an horizontally disposed plate 45 (FIG. 2) has, adjacent to the container lid latch 43 and a corresponding and oppositely disposed container lid latch 46, a pair of perpendicular, vertically oriented horizontally adjustable flanges 47, 50 to which the respective latches 43, 46 are connected.

As best shown in FIG. 2, the latches 43, 46 can be activated in order to wedge, or to otherwise press the plate 45 of the frame 44 against a pair of bearing pads 53 and 53' that are interposed between the flanges 47, 50 and the horizontal surface of the container lid 42. In this way, the pressing of the bearing pads 53 and 53' against the container lid 42 further improves the stable, steady nature of the light weight structure that characterizes this invention.

A generally rectangular hollow support 54 is provided with two threaded recesses (not shown) which are coaxially located on opposite sides of the support 54. Also provided on support 54 is a bore (also not shown) that is horizontally displaced from, and on an axis which is generally parallel to, the axis of the threaded recesses (not shown). The support 54 is further provided with attachment pads 58 and 59, clearly shown in FIG. 2, which are formed to receive and secure accessorial equipment, such as a pole on which examination lights, intravenous bottles, and other operational equipment can be attached. The support 54 attaches to plate 45, in a manner well known in the art, and is lodged between flanges 47 and 50.

Referring now to FIG. 1, it can be seen that a seat 63 is mounted on a pair of oppositely disposed parallel adjustment plates 56 and 56'. Adjustment plate 56 is shown in FIG. 1. Adjustment plates 56 and 56' are formed with holes to respectively receive shoulder bolt 55 and shoulder bolt 55' in a manner suggested in FIG. 1. Adjustment plate 56 is further provided with adjustment holes, of which only adjustment holes 60, 61, and 62 are shown, that can be equidistantly spaced, each from the next adjacent, on an arc of a circle whose center is the hole formed in plate 56 which receives the shoulder bolt 55.

Seat 63 is connected to support 54 by shoulder bolts 55 and 55' which are received and secured in the respective threaded recesses in support 54, after being respectively inserted into the holes provided for this purpose in plates 56 and 56'. This connection permits rotation of seat 63 on the shoulder bolts 55 and 55' about an axis defined by the center line of the recesses formed on support 54.

As can be best seen in FIG. 1, the rake, or angular elevation, of the seat 63 relative to the container lid 42, is determined by its angle of rotation around shoulder bolts 55 and 55'. In order to control such rotation and keep seat 63 at a particular rake, a locking pin 57, disposed in the bore of support 54, is inserted into one of the adjustment holes 60, 61, or 62. FIG. 1 shows the locking pin 57 inserted into adjustment hole 60. Changes in the rake of seat 63 are accomplished by withdrawing locking pin 57 from the adjustment hole 60, 61, or 62 into which it is had been inserted and then allowing rotation of seat 63 to a desired rake where there is again an alignment of locking pin 57 with one of the adjustment holes 60, 61, or 62. The locking pin 57 is then inserted into the adjustment hole 60, 61, or 62 with which it is aligned. During the above described operation, withdrawal of locking pin 57 from an adjustment hole 60, 61, or 62 is accomplished by raising the manual lever 52 to activate a spring-loaded interconnect, that is known in the art, with the locking pin 57. Upon release of the manual lever 52, the spring-loaded interconnect (not shown) urges locking pin 57 into an adjustment hole 60, 61, or 62 when the locking pin 57 is aligned with one of the adjustment holes 60, 61, or 62. As shown in FIG. 1, a stop 69, attached to adjustment plate 56, interacts with the frame 54, in a manner well known in the art, to prevent overtravel of the rake of seat 63.

In a slightly modified embodiment, the adjustment plate 56' is formed with adjustment holes 60', 61', and 62' that are opposite and symetrical to the adjustment holes 60, 61, and 62 and which interact with a locking pin 57' upon operation of the manual lever 52 in the manner described above. In this manner the locking pins 57 and 57' can be simultaneously inserted into the respective adjustment holes on adjustment plates 56 and 56' to provide additional rigidity for the seat 63.

As previously described, the upper edges of the adjustment plates 56 and 56' are connected to a generally transverse and essentially horizontally disposed seat 63. The seat 63 terminates, on the end adjacent to the edge of the container 32, in hollow transversly spaced receptacles 64, 65. The opposite end of the seat 63, moreover, forms part of an hinge 66 in which hinge pin 67 in retained in place by means of a cotter key 68.

Swingable portion 70 of the hinge 66 is received in the hinge in a manner that permits the swingable portion to be angularly adjusted relative to the seat 63. Rectangular holders 71, 72 are joined, each to a respective spaced end of the swingable hinge portion 70, in order to fit within open ends of a tubular frame for a back rest 73. As shown, for instance, in FIGS. 1 and 2, the shape of the back rest 73 conforms roughly to an inverted U. The back rest 73 has an uppermost head rest 74 that is joined to the vertical members of the back rest 73 by means of a further hinge 75 that permits the head rest 73 to fold downwardly toward the seat 63 and lay directly against and parallel with the upright vertical members.

FIG. 1 shows the assembly which positions back rest 73 relative to the seat 63. A piston drive 108, well known in the pertinent art, is fastened to the seat 63 on its under side, as shown in FIG. 1. Extending from the piston drive 108 is a piston 106 which is recipiocally movable in both translation and rotation upon activation of the piston drive 108 by a piston drive actuator (not shown). At the end of piston 106, opposite from the piston drive 108, a coupling pin 104 connects piston 106 to a brace 102. Brace 102, in turn, is attached, by means known in the art, to the swingable hinge portion 70 that connects with back rest 73 as previously described.

Turning once more to the seat 63, attention is invited to the receptacles 64, 65. As shown in FIG. 2, a U-shaped foot rest 76 has, at the respective ends of upright members 77, 80, curved portions of which only the portion 81 is shown in FIG. 1. As illustrated, the curved portion 81 on the foot rest forms an angle of about 90° relative to the upright members 77, 80 in the plane of FIG. 1 of the drawing. The curved portion 81 is received within the recess in the mating receptacle 64 and is held firmly in place through a suitable friction fit with the receptacle. A similar connection is completed with the corresponding curved portion (not shown in the drawing) of the upright member 80. As described more fully hereinafter, a leg rest 82 (FIG. 1), in which the area between essentially horizontally disposed and parallel spaced leg rest members 83, 84 is covered with a metal sheet 85 can be substituted in the receptables 64, 65 for the foot rest 76 (FIGS. 1 and 2).

To complete the description of the structural features of the apparatus that characterizes the specific embodiment of the invention under consideration, attention is invited to FIG. 2 in which sockets 86, 87, are shown fastened to the respective adjustment plates, of which only the adjustment plate 56 in FIG. 1 is illustrated. Thus, the socket 86 is secured to the plate 56 near shoulder bolt 55, between the shoulder bolt 55 and the edge of the plate that is opposite to the adjustment holes 60, 61, and 62. The sockets 86, 87 receive generally vertical, tubular arm rest supports 90, 91 that protrude above the plane of the seat 63. The arm rest supports 90, 91 in turn, sustain individual arm rests 92, 93. As shown in FIGS. 1 and 2, the arm rests 92, 93 each form acute angles with the horizontal plane in order to provide flat surfaces to enable the occupant of the apparatus to rest right and left forearms with a reasonable degree of comfort. Arm rests 92, 93 are adjustable and can be positioned out of the plane defined by the respective adjustment plates 56, 56' for allowing ease of patient access to and egress from the seat 63.

Figure 3:
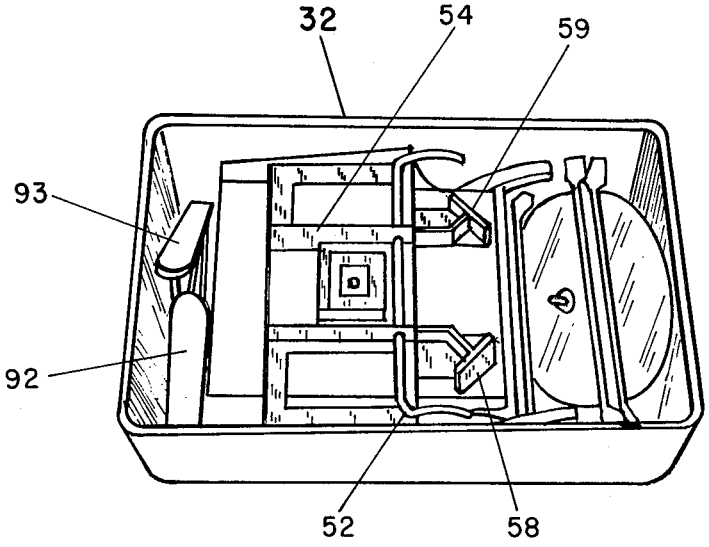
FIG. 3 is a perspective view of the invention disassembled and packed for storage or transportation.

In operation individual components of the medical examining chair are withdrawn from the interior of the container 32 as shown in FIG. 3. After all of the components are removed from the interior of the container 32, the container is closed by replacing the container lid 42 (FIG. 1) and latching this lid shut. In accordance with a salient feature of the invention, the container 32 is incorporated into the structure of the invention to strengthen and stabilize the light weight device by attaching the legs, of which the legs 10, 11 shown in FIG. 2 are typical. As shown, the legs 10, 11 are aligned on opposite sides of the bottom edge of the container 32, near adjacent container corners. Portions of the container edges are received in the respective channel members. While so retaining legs 10, 11 in contact with the container, edges fasteners, of which the fastener 41, is illustrative, are engaged with the top of the container lid 42 and the associated toggle latches (e.g. the toggle latch 40) are snapped shut to press the channel members 30, 31 into tight contact with the container 32. Final tightening and adjustment for the legs 10, 11 is accomplished by manipulating the turnbunckle 36 to draw the brace 35 into a suitable degree of tension with the legs to which it is connected.

The bearing pads 53, 53' and the plate 47 now are positioned in a suitable place on the container lid 42, depending on the desired use of the apparatus. Illustratively, for application in a chair like configuration, the receptacles 64, 65 should protrude slightly beyond the edge of the container 32, as shown in FIG. 1. When the apparatus is to be used as an examining table, however, it may be preferable to mount the bearing pads 53, 53' and the plate 47 more centrally on the top of the container lid 42. In this latter mode of operation, the receptacles 64, 65 should generally remain within the bounds of the perimeter established by the container lid 42.

Continuing with the description of the apparatus, the frame 44, the underlaying plate 45 and the bearing pads 53 and 53' are secured to the lid latch 46 in FIG. 2 and the two additional latches, (of which only the latch 94 is shown in FIG. 1 of the drawing) with the gap between the edge of the container lid 42 and the body of the container 32. Consequently the support 54, the frame 44 and the bearing pads 53 and 53' all are pressed against the top of the container.

Piston drive 108, is attached to the bottom of seat 63. Then, seat 63 and its associated adjustment plates, of which the plate 56 in FIG. 1 is typical, are placed over the support 54 to allow the shoulder bolts 55, 56' to secure into the recesses of support 54 when inserted through the appropriate holes on adjustment plate 56 and 56'. The shoulder bolts 55, 55' are then secured in the recesses of support 54 and seat 63 is left free to rotate on the shoulder bolts 55, 55'. In a more expedient operation, seat 63 can be previously attached to support 54. Thus eliminating the need to make this connection.

To fix the "rake", or angular elevation of the seat 63 relative to the container lid 42, the locking join 57 is inserted in any horizontally coordinate adjustment hole as, for example, the adjustment hole 60 shown in FIG. 1.

The swingable portion 70 is connected to the back end of seat 63 by hinge pin 67 and the brace 102 is connected, in a manner known in the art, to the swingable portion 70. Connection of the brace 102 to piston 106 by means of the linking pin 104 permits actuation piston 106 to control the position of swingable portion 70 relative to seat 63. Back rest 73, with or without head rest 74 attached, can be secured to swingable portion 70 with the result that actuation of piston 106 will control position of the back rest 73. In a more expedient operation, the back rest 73 remains attached to seat 63 and only linking pin 104 is removed to disconnect piston 106 pin from brace 102. This operation allows back rest 73 to be rotated to lie adjacent to seat 63 for storage in container 32.

Depending upon the use to be made of the portable examination chair, foot rest 76 or alternatively, leg rest 82 can be attached to seat 63 at the receptacles 64, 65. Also, in accordance with the desires of the patient or the examiner, arm rest 92 and its connecting support 90 can be attached at socket 86. In a like manner, or alternatively, arm rest 93 and its connecting support 91 can be attached at socket 87.

With the combination assembled, any variety of accessory equipment can be used during examination. Attachment pads 58, 59 provide points at which such accessories can be mounted in a variety of ways, all of which are well known in the art. Also, if necessary, accessories can be mounted directly on the container 32.

We claim:

1. A portable and stable multi-component reclining chair suitable for the practice of military medicine in the field comprising:

a container for removably storing components of said chair, said container having two pairs of opposite sides, an upper surface and a lower surface;

a plurality of legs;

means for detachably securing said legs to said lower surface and to one pair of said two pairs of sides of said container for supporting said container on the ground;

each of said legs having independent screws studs for adjusting its length to level said container when on uneven ground;

said components further comprising;

a seat having a back edge and a front edge;

means for detachably mounting said seat to said upper surface of said container;

a back rest rotatably attached to said back edge of said seat;

means for rigidly positioning said back rest relative to said seat; and a head rest pivotably and adjustable attached to said back rest for supporting a patient's head.

2. A portable multi-component reclining chair as cited in claim 1 further comprising:

a head rest adjustably attached to said back rest for supporting a patient's head.

3. A portable multi-component reclining chair as cited in claim 2 further comprising:

at least one support removably attached to said rest for resting a patient's arm.

4. A portable multi-component reclining chair as cited in claim 3 further comprising:

a foot rest removably attached to said front edge of said seat for supporting a person's feet.

5. A portable multi-component reclining chair as cited in claim 3 further comprising:

a leg rest removably attached to said front edge of said seat for supporting a person's lower extremities.

6. A portable multi-component reclining chair as cited in claim 4 or claim 5 further comprising:

means for adjusting the rake of said seat.

7. A portable and stable multi-component reclining chair suitable for the practice of military medicine in the field comprising:

a container for removably storing components of said chair, said container having two pairs of opposite sides, an upper surface and a lower surface;

said components further comprising:

a plurality of legs, means for detachably securing said legs to said lower surface and to one pair of said two pairs of opposite sides of said container for supporting said container on the ground;

each of said legs having independent screw studs for adjusting its length to level said container when on rough ground;

each of said screw studs having a flat bearing surface movably attached to an end of said screw stud for adjustable contact with the ground;

a seat having a back edge and a front edge;

means for detachably mounting said seat to said upper surface of said container;

a back rest rotatably attached to said back edge of said seat;

means for rigidly positioning said back rest relative to said seat;

a head rest adjustably attached to said back rest for supporting a patient's head;

at least one support removably attached to said seat for resting a patient's arm;

a leg rest removably attached to said front edge of said seat for supporting a person's lower extremities; and means for adjusting the rake of said seat.

* * * * *